US009927135B2

(12) United States Patent
Hung

(10) Patent No.: US 9,927,135 B2
(45) Date of Patent: Mar. 27, 2018

(54) CHARGE MANAGEMENT FOR AIR CONDITIONING

(71) Applicant: Lennox Industries Inc., Richardson, TX (US)

(72) Inventor: Der-Kai Hung, Dallas, TX (US)

(73) Assignee: Lennox Industries Inc., Richardson, TX (US)

( * ) Notice: Subject to any disclaimer, the term of this patent is extended or adjusted under 35 U.S.C. 154(b) by 180 days.

(21) Appl. No.: 15/082,545

(22) Filed: Mar. 28, 2016

(65) Prior Publication Data

US 2016/0209056 A1 Jul. 21, 2016

Related U.S. Application Data

(63) Continuation of application No. 13/976,000, filed on Aug. 26, 2013, now Pat. No. 9,297,565.

(51) Int. Cl.

| | |
|---|---|
| ***F24F 3/14*** | (2006.01) |
| ***F24F 3/153*** | (2006.01) |
| ***F25B 45/00*** | (2006.01) |

(52) U.S. Cl.

CPC ..... *F24F 3/1405* (2013.01); *F24F 3/153* (2013.01); *F25B 45/00* (2013.01); *F25B 2345/003* (2013.01); *F25B 2400/01* (2013.01)

(58) Field of Classification Search

CPC .. F24F 3/14; F24F 3/1405; F24F 3/153; F24F 11/0012; F24F 11/0015; F25B 43/006; F25B 45/00; F25B 2345/003

USPC ..... 62/173, 176.6, 503

See application file for complete search history.

(56) References Cited

U.S. PATENT DOCUMENTS

| | | | | |
|---|---|---|---|---|
| 3,264,840 A * | 8/1966 | Harnish | ..... | F24F 3/0525 62/173 |
| 3,362,184 A * | 1/1968 | Jensen | ..... | F24F 3/1405 62/160 |
| 9,297,565 B2 * | 3/2016 | Hung | ..... | F25B 45/00 |

* cited by examiner

*Primary Examiner* — Marc Norman

(74) *Attorney, Agent, or Firm* — Baker Botts L.L.P.

(57) ABSTRACT

In various implementations, an air conditioning system may automatically adjust an amount of refrigerant using an accumulator. The air conditioning system may operate in at least two operation modes including a cooling operation and a reheat operation. The amount of refrigerant allowed to flow to a condenser of the system may be based at least partially on the operating mode of the air conditioning system.

15 Claims, 5 Drawing Sheets

CHARGE MANAGEMENT FOR AIR CONDITIONING

CROSS REFERENCE TO RELATED INFORMATION

This application is a continuation of U.S. patent application Ser. No. 13/976,000, filed Aug. 26, 2013, titled "Charge Management For Air Conditioning", the contents of which are hereby incorporated herein in its entirety.

TECHNICAL FIELD

The present disclosure relates to managing refrigerant charges in air conditioning systems.

BACKGROUND OF THE INVENTION

Air conditioners may cool air and, in the process, also dehumidify air. However, in high humidity environments or humidity sensitive environments (e.g., wafer fabrication facilities), a user may request that an air conditioner dehumidify air beyond the dehumidification of the air that accompanies the reduction in air temperature.

A reheater may be included in the system to increase the dehumidifying capacity without overcooling the air. The reheater may increase the temperature of the air leaving the evaporator. By increasing the temperature of the air, moisture from the air may continue to be removed (e.g., when the air passes over the evaporator coils, water in the air is condensed) without overcooling a location.

BRIEF SUMMARY OF THE INVENTION

In various implementations, an air conditioning system may include two or more operation modes, such as a cooling operation and a reheat operation. The cooling operation may cool air and dehumidify air. The reheat operation may cool air less than the cooling operation by heating the air prior to allowing the air to flow to the conditioned space. The reheat operation may dehumidify the air while inhibiting overcooling.

In various implementations, a request may be received from a user for operation of an air conditioner. The request may include a setpoint temperature and/or a setpoint humidity. A temperature proximate at least a portion of the air conditioner may be determined, and a humidity proximate at least a portion of the air conditioner may be determined. A cooling operation may be allowed, if the determined temperature is not within a predetermined range of the setpoint temperature. The cooling operation may include: restricting refrigerant flow from a compressor outlet to a reheater; allowing a first portion of refrigerant flow from the compressor outlet to an accumulator; and allowing a second portion of refrigerant flow from the compressor outlet to a condenser. A reheat operation may be allowed, if the determined temperature is within the predetermined range of the setpoint temperature. The reheat operation may include: allowing refrigerant flow from the compressor outlet to the reheater; and allowing refrigerant flow from the accumulator to a compressor inlet.

Implementations may include one or more of the following features. The setpoint humidity may include a default humidity. A request for alteration of the default humidity may be received, and the setpoint humidity may be adjusted based on the request for alteration. The cooling operation may be allowed, if the determined humidity is within a second predetermined range of the setpoint humidity and the determined temperature is not within the predetermined range of the setpoint temperature. Operation of the air conditioner may be restricted, if the determined humidity is within a second predetermined range of the setpoint humidity and the determined temperature is within the predetermined range of the setpoint temperature. The setpoint humidity may include a relative humidity and/or an absolute humidity.

In various implementations, an air conditioning system may include a condenser, a compressor, an evaporator, a reheater, a valve, and an accumulator. The valve may be coupled proximate an outlet of the compressor and may control an amount of refrigerant allowed to flow to the condenser. The valve may include a first setting and a second setting. The first setting may allow a first amount of refrigerant to flow to the condenser. The second setting may allow a second amount of refrigerant to flow to the reheater. The second amount of refrigerant may be greater than the first amount of refrigerant. The accumulator may be coupled to the valve such that at least a portion of the refrigerant from the outlet of the compressor is allowed to flow to the accumulator when the valve is in the first setting. The refrigerant from the accumulator may be allowed to flow to an inlet of the compressor when the valve is in the second setting.

Implementations may include one or more of the following features. The condenser may include a microchannel condenser. The valve may include a four-way valve. The air conditioner may include a first check valve and a second check valve. The first check valve may restrict the flow of refrigerant from a condenser inlet through the first check valve to a compressor outlet. The second check valve may restrict the flow of refrigerant from a condenser inlet through the second check valve to the reheater.

In some implementations, the air conditioning system may include a first check valve to restrict flow of refrigerant from a condenser inlet through the first check valve to a compressor outlet, and a second check valve to restrict flow of refrigerant from a condenser inlet through the second check valve to the reheater. The accumulator may be coupled to the line coupling the valve and the second check valve. The air conditioning system may include an indoor portion and/or outdoor portion. The indoor portion may include the evaporator and the accumulator. The outdoor portion may include the condenser and the accumulator. The air conditioning system may include a controller that includes an operating module adapted to determine whether to allow a cooling operation and/or a reheat operation. The controller may include an operating module to determine whether to allow a cooling operation or a reheat operation. Determining whether to allow a cooling operation or a reheat operation may include comparing one or more setpoint conditions to one or more conditions determined proximate at least a portion of the air conditioner.

In various implementations, at least one setpoint condition may be received, from a user, for operation of an air conditioner and condition(s) proximate at least a portion of the air conditioner may be determined. An amount of refrigerant allowed to flow from a compressor outlet to a condenser inlet may be automatically adjusted. Adjusting an amount of refrigerant may include adjusting the amount of refrigerant between a first level and a second level based at least partially on a comparison of at least one of the setpoint conditions and at least one of the determined conditions. The amount of refrigerant allowed to flow from the compressor outlet to the condenser inlet may be adjusted by directing the flow from an accumulator.

Implementations may include one or more of the following features. One or more of the determined conditions may include temperature, humidity, and/or pressure. At least one of the setpoint conditions and/or at least one of the determined conditions may include humidity. The amount of refrigerant may be adjusted when the determined humidity is not within a predetermined range of the setpoint humidity. In some implementations, the amount of refrigerant allowed to flow from the compressor outlet to the condenser inlet may be decreased by allowing an amount of refrigerant from the compressor outlet to flow into the accumulator. The amount of refrigerant may be decreased when a cooling operation of the air conditioner is allowed. In some implementations, the amount of refrigerant allowed to flow from the compressor outlet to the reheater inlet may be increased by allowing an amount of refrigerant from the accumulator to flow to a compressor inlet. The amount of refrigerant may be increased when a reheating operation of the air conditioner is allowed.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

In various implementations, the amount of refrigerant allowed to circulate through portions of an air conditioning system may be automatically adjusted based on an operation of the air conditioning system. For example, an air conditioning system may allow a cooling operation and a reheat operation. When a component, such as a reheater (e.g., a heat exchanger) is used with the system to raise the temperature of the air allowed to flow to the conditioned space, a first level of refrigerant may be allowed. When the flow of refrigerant through the component, such as a reheater, is restricted, the amount of refrigerant allowed may be reduced to a second level. An accumulator coupled proximate the condenser (e.g., coupled to a line between the compressor and the condenser) and a valve may be utilized to adjust the amount of refrigerant (e.g., allowed to flow to the condenser). However, when operating the reheater in a reheat operation, a greater amount of refrigerant (e.g., a greater refrigerant charge) may need (e.g., listed in air conditioner specifications to inhibit mechanical failure) to be supplied to the air conditioning system to allow operation of the reheater (e.g., when compared to an amount of refrigerant that is listed in air conditioner specifications to inhibit mechanical failure and to allow operation of the air conditioning system when the reheater is not utilized). Thus, if the air conditioning system is allowed to operation at the same refrigerant charge when the reheater is or is not in operation, the system may be overcharged which may decrease efficiency, increase operation costs, and/or cause the system to fail.

In some implementations, the cooling operation may reduce a temperature of a location by providing cooled and/or dehumidified air. The reheat operation may allow a temperature of a location to be reduced by providing cooled and/or dehumidified air. During the reheat operation overcooling (e.g., cooling exceeding a setpoint) may be inhibited. Since each operation mode operates to reduce a condition to a setpoint faster than another condition, an air conditioning system with both modes may allow different setpoints to be satisfied by operation of the system (e.g., a setpoint temperature and/or a setpoint humidity) while inhibiting exceeding a setpoint (e.g., overcooling and/or over dehumidifying), which may decrease cost efficiency.

Figure 1A:
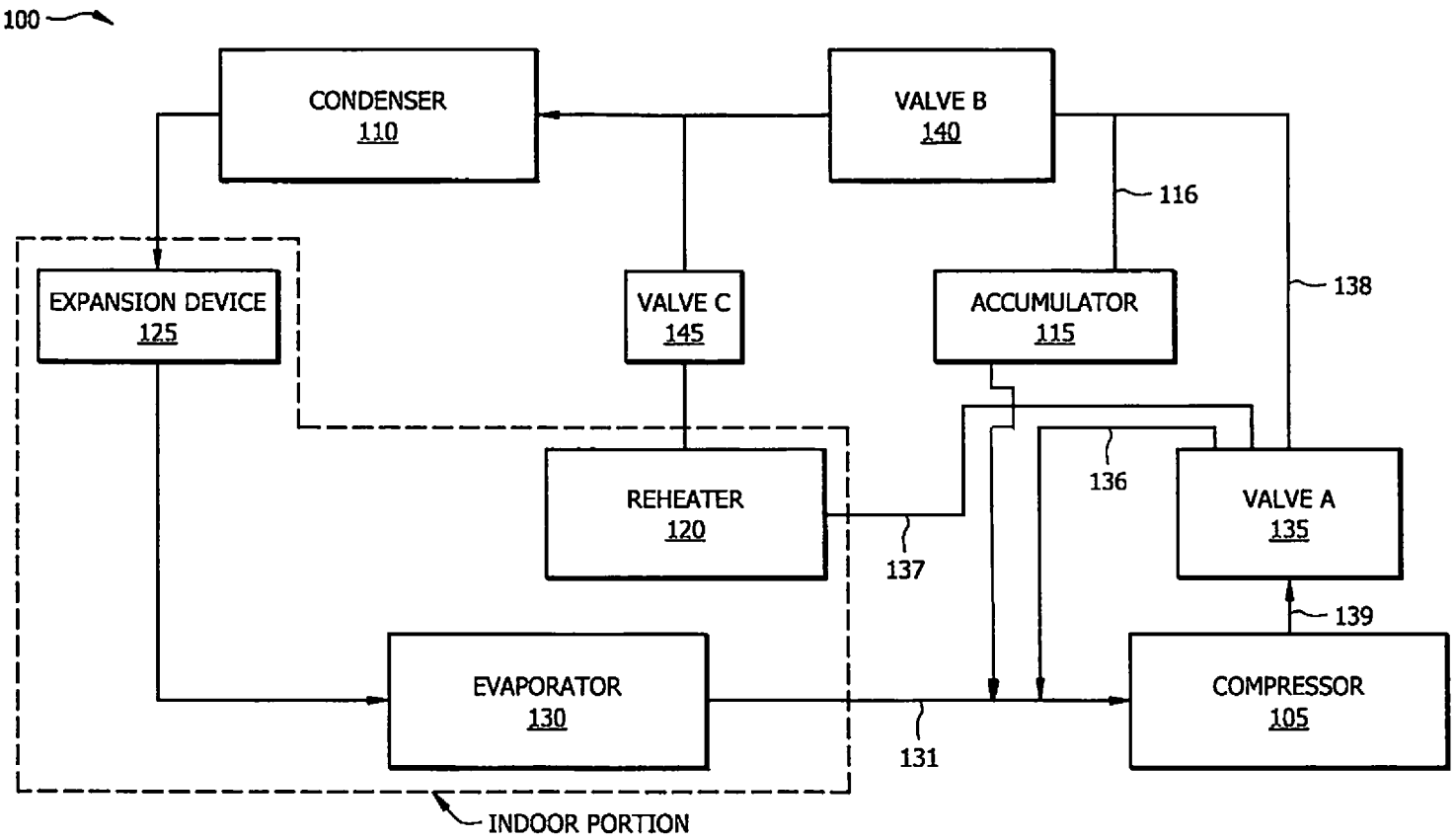
FIG. 1A illustrates an implementation of an example air conditioning system.
Figure 1B:
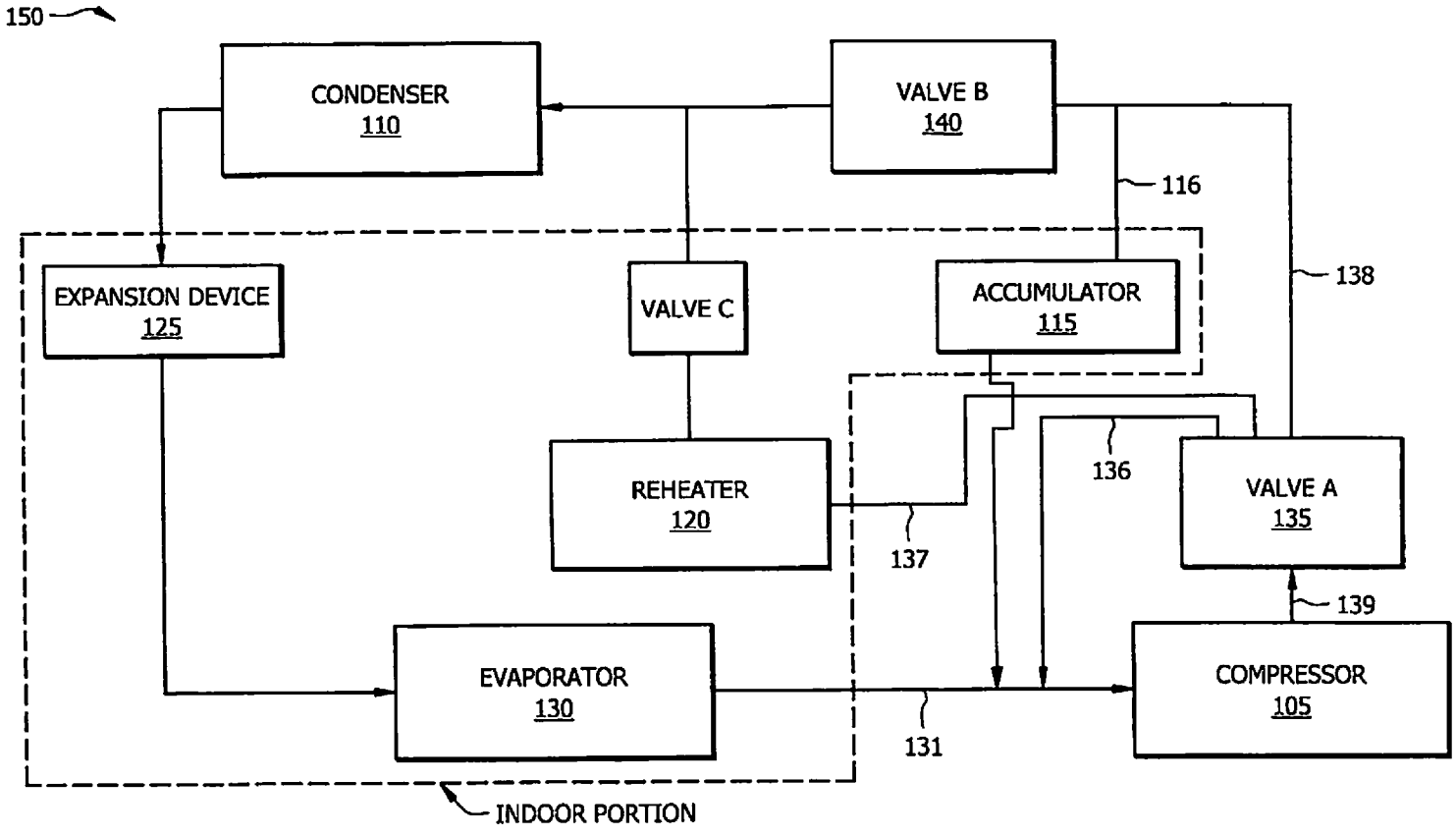
FIG. 1B illustrates an implementation of an example air conditioning system.

FIG. 1A illustrates an implementation of an example of an air conditioning system 100. FIG. 1B illustrates an implementation of an example air conditioning system 150. As illustrated, the air conditioning system 100 includes components, such as a compressor 105, condenser 110, accumulator 115, reheater 120, expansion device 125, evaporator 130, refrigerant lines coupling various components, and valves controlling the flow of refrigerant (e.g., valve A 135, valve B 140, and valve C 145).

In some implementations, the components of the air conditioning system may be disposed in the same location (e.g., inside a building, outside a building, proximate a location in which the environment will be controlled, such as a laboratory, manufacturing facility, and/or refrigeration unit). In some implementations, a portion of the air conditioning system may be disposed indoor (e.g., an indoor portion disposed inside a building) and a portion of the air conditioning system may be disposed outdoor (e.g., outdoor portion disposed outside a building). For example, the indoor portion may include the reheater 120, the expansion device 125, and the evaporator 130. The outdoor portion may include the compressor 105 and the condenser 110. As illustrated in FIG. 1A, the accumulator 115 may be disposed in an outdoor portion of the air conditioning system 100. As illustrated in FIG. 1B, the accumulator 115 may be disposed in an indoor portion of the air conditioning system 100, in some implementations. The valves, such as valve A 135 and valve B 140 may be disposed in the outdoor portion, in some implementations. As illustrated in FIGS. 1A and 1B, the valve C 145 may be disposed in the indoor portion or the outdoor portion. In some implementations, valve B and valve C may be check valves or other types of one-way valves, as appropriate. Valve B may allow fluid to flow through valve B to an inlet of the condenser 110 and restrict fluid from flowing from the inlet of the condenser through valve B to other components of the system 100. Valve C may allow fluid to flow to an inlet of the condenser through valve C and restrict fluid from flowing from the inlet of the condenser through valve C to other components of the system 100.

The air conditioning system 100 may include more than one operating mode, and the flow of refrigerant through the system may be based at least partially on the operation mode.

For example, during a cooling operation, the flow of refrigerant to the reheater 120 may be restricted so that operation of the reheater may be inhibited. The refrigerant exiting the compressor 105 may flow to valve A 135. Valve A 135 may be a four way valve or other type of reversing valve. During the cooling operation, valve A may be in a first setting. The first setting may couple line 136 (e.g., coupled to a suction line 131 of the compressor 105) and line 137 (e.g., coupled to an inlet of a reheater 120). Thus, during operation at the first setting, refrigerant in the reheater 120 flows to the inlet of the compressor 105 via line 137, 136, and the suction line 131. The first setting may couple line 138 (e.g., coupled to valve B 140 and the accumulator 115) and line 139 (e.g., coupled to the outlet of the compressor 105). Thus, refrigerant may flow from the outlet of the compressor 105 to valve B 140 via lines 139 and line 138.

During the cooling operation, refrigerant may flow through valve A 135 to valve B 140, which allows a first portion of the refrigerant to flow to the accumulator 115 and allows a second portion of the refrigerant to flow through valve B 140 to the condenser 110. The refrigerant in the accumulator 115 may be at least partially in the liquid phase at high pressure (e.g., 400 psi and approximately 95 degrees Fahrenheit, when the refrigerant includes R-410A refrigerant) since it is coupled to the high-pressure side of the air conditioning system 100 via the outlet of the compressor 105. The capacity of the accumulator 115 may be sized based on properties of the air conditioning system 100, such as the refrigerant charge specifications of the air conditioning system operation during a cooling mode or a reheat mode (e.g., the amount of refrigerant for optimum operation), housing capacity, location space availability, standard container sizing, etc. As the accumulator 115 is filled or approximately filled with refrigerant, the refrigerant from the outlet of the compressor 105 may flow through valve B 140 to the condenser 110 (e.g., since more refrigerant may not be able to be housed in the accumulator 115, for example, when the accumulator has reached its capacity). Refrigerant may be condensed from a gas at a first temperature to a liquid at a second temperature that is lower than the first temperature. The refrigerant may flow through the condenser 110 to an expansion device 125 (e.g., a device that at least partially expands the refrigerant, such as a thermal expansion valve), and then to an evaporator 130, which evaporates the liquid refrigerant to a gas at low pressure. Air may flow over the evaporator 130 such that the temperature of the air may be reduced and then provided to a location (e.g., a room in which air conditioning at a setpoint temperature and/or humidity is requested). As the air flows over the evaporator, water may be removed from the air and condensed at the surface of the evaporator 130. The water condensed (e.g., condensate) may leave the evaporator 130 via a drain line (e.g., coupled to a sewer line or other drainage line). Thus, the evaporator 130 may cool the air and dehumidify the air during the cooling operation of the air conditioning system 100. The refrigerant leaves the evaporator 130 as a gas at a low pressure and then is allowed to flow to the compressor 105, in which the refrigerant is compressed to a higher pressure gas. During the cooling operation, the operation of the reheater 120 may restricted (e.g., flow through may be restricted). The first setting of valve A 135 couples the reheater 120 to the suction line 131 of the compressor 105, and so, in some implementations, the reheater may be drained of refrigerant (e.g., by being coupled to the suction line) and/or be approximately emptied.

During the reheat operation, overcooling of air may be inhibited while allowing dehumidification of the air using a reheater 120 (e.g., a heat exchanger). During the reheat operation, refrigerant from the outlet of the compressor 105 may flow to valve A 135. Valve A 135 may be a reversing valve. During the reheat operation, the valve A 135 may be in a second setting. The second setting may couple line 136 (e.g., coupled to a suction line 131 of the compressor 105) and line 138 (e.g., coupled to valve B 140 and the accumulator 115). Since valve B 140 may be a check valve that restricts flow from the inlet of the condenser 110, refrigerant from the accumulator 115 (e.g., disposed proximate and upstream of valve B) may be allowed to flow through Valve A 135 to the line 136 and the suction line 131 to the inlet of the compressor 105. Thus, during the reheat operation, refrigerant in the accumulator 115 may be coupled to the low-pressure side of the air conditioning system 100, and so the refrigerant may reside at least partially in a gaseous stage at low pressure (e.g., 140 psi and/or approximately 60 degrees Fahrenheit to approximately 85 degrees Fahrenheit, with a refrigerant that includes R-410A refrigerant). The accumulator 115 may be empty or at least partially empty since it is coupled to the inlet of the compressor 105 (e.g., via lines 116, 138, and 136).

During the reheat operation, the second setting of valve A 135 may couple line 137 (e.g., coupled to the reheater inlet) and line 139 (e.g., coupled to the compressor outlet). Thus, refrigerant from the outlet of the compressor 105 may flow through valve A 135 to reheater 120. The reheater 120 may be a heat exchanger that increases the temperature of the air flowing through the reheater. The refrigerant may exit the reheater 120 and flow through valve C 145 to the condenser. Valve C 145 may restrict flow from the inlet of the condenser 110 back to the reheater 120. Refrigerant may be condensed from a gas at a first temperature to a liquid at a second temperature that is lower than the first temperature, in the condenser 110. The refrigerant may flow through the condenser 110 to an expansion device 125, and then to an evaporator 130, which evaporates the liquid refrigerant to a gas at low pressure. Air may flow over the refrigerant in the evaporator 130 such that the temperature of the air may be reduced and then provided to a location (e.g., a room in which air conditioning at a setpoint temperature and/or humidity is requested). However, since the reheater 120 raised the temperature of the air prior to entering the conditioned space and thus as the air flows over the reheater, overcooling may be inhibited. As the air flows over the evaporator, water may be removed from the air and condensed at the surface of the evaporator 130. Thus, the evaporator 130 may cool the air, while overcooling is inhibited, and dehumidify the air during the reheat operation of the air conditioning system 100. The refrigerant leaves the evaporator 130 as a gas at a low pressure and then is allowed to flow to the inlet of the compressor 105, in which the refrigerant is compressed to a higher pressure gas.

Although FIG. 1A and FIG. 2A illustrate specific implementations of air conditioning systems, other implementations may be utilized, as appropriate. In various implementations, specific components of the air conditioning system have been described. Any appropriate component may be utilized with the described systems and processes. For example, a compressor may be any appropriate compressor.

In some implementations, an accumulator may be more than one container. The accumulators may be coupled with each other and/or coupled to line 138. The accumulator may include a single container, in some implementations. In some implementations, an expansion valve may not be included in the air conditioning system. Although valve B and valve C are illustrated, as check valves, other valves may be utilized, as appropriate. For example, valve B and/or valve C may include other types of one-way valves. In some implementations, valve B and/or valve C may include a stop valve that restricts or allows flow to an inlet of the condenser based on the operation mode of the air conditioning system. Valve C may allow flow through the valve during reheat operations and restrict flow through the valve during cooling operations. In some implementations, valve C may allow flow to the condenser during cooling operations and restrict flow through valve B during reheat operations.

In some implementations, the air conditioning system may include a controller (not shown). The controller may be coupled to various components of the air conditioning system and/or manage various operations of one or more of the components. The controller may include a computer and include a memory and a processor. The processor may execute instructions and manipulate data to perform operations of the controller. The processor may include a programmable logic device, a microprocessor, or any other appropriate device for manipulating information in a logical manner and the memory may include any appropriate form(s) of volatile and/or nonvolatile memory, such as RAM and/or Flash memory.

The memory may store data such as predetermined values (e.g., air conditioning specifications, such as for refrigerant charges; operating levels for refrigerant charges; predetermined ranges for conditions; default settings; criteria for determining which operation mode to allow; settings for valves in various operation modes; monitored data, such as determined conditions; and/or other data useful to the operation of the air conditioning system and/or various modules of the air conditioning system). Various software modules may be stored on the memory and be executable by the processor of the controller. For example, instructions, such as operating systems and/or modules such as an operation module may be stored on the memory. The operation module may manage operations and/or components (e.g., heat exchangers, valves, lines, fans, and/or compressors) of the air conditioning system such as responding to requests, determining operating parameters of various components of the air conditioning system, operating a reversing valve of a heat pump air conditioning system, receive and/or process requests for air conditioning system operations, determine components operating parameters (e.g., speeds of component operations, on/off switch settings of components, and/or valve settings), monitor conditions proximate the air conditioning system, determining whether to allow a cooling operation and/or a reheat operation, compare setpoint conditions to monitored conditions, retrieve data, automatically adjust valve settings, automatically adjust an amount of refrigerant, etc.

The air conditioning system includes an air conditioner. The air conditioning system may include other components such as computers utilized by field technicians, etc.

Figure 2:
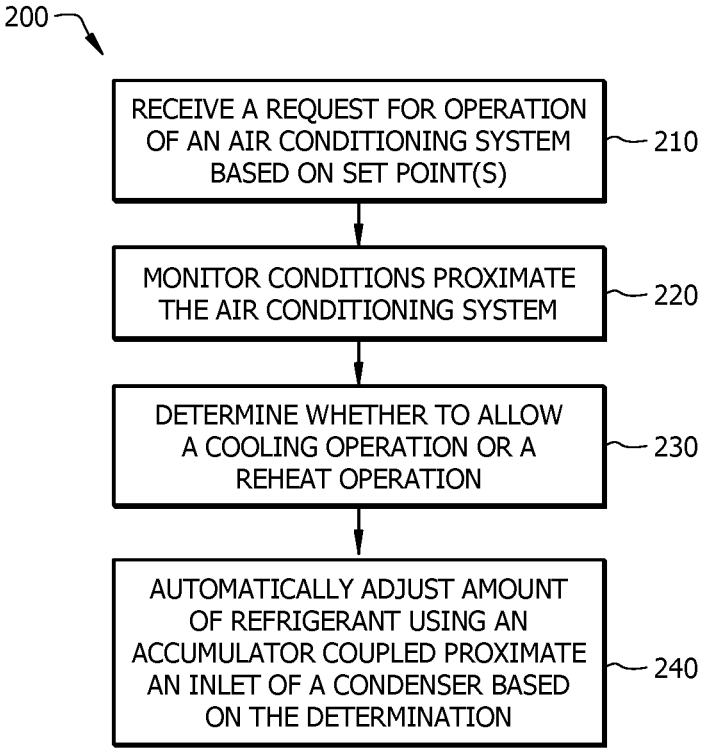
FIG. 2 illustrates an implementation of an example process for operating an example air conditioning system, such as the air conditioning system illustrated in FIGS. 1A and/or 1B.

The air conditioning system may automatically adjust the amount of refrigerant allowed to flow through the system, using accumulator, based on the operation mode. FIG. 2 illustrates an implementation of an example process 200 for operating the air conditioning system. As illustrated, a request for operation of an air conditioning system based on setpoint(s) may be received (operation 210). For example, a user may enter a setpoint temperature and/or humidity on a controller (e.g., indoor thermostat). The setpoint may include a temperature, range of temperatures, humidity, range of humilities, and/or other conditions.

Condition(s) proximate the air conditioning system may be monitored (operation 220). The conditions monitored may be the same conditions as the conditions in the setpoint of the received request. The air conditioning system may include one or more sensors to measure the conditions. The conditions may be determined based on the measurements and/or stored in a memory of the air conditioning system.

A determination may be made whether to allow a cooling operation or a reheat operation (operation 230). For example, the air conditioning system may determine which operation mode (e.g., cooling operation or reheat operation) to allow based on the monitored conditions. A cooling operation may be allowed when one or more of the monitored conditions is not within a predetermined range of one or more of the setpoint conditions and a reheat operation may be allowed when one or more of the monitored conditions is not within the predetermined range of one or more of the setpoint conditions, in some implementations.

An amount of refrigerant may be automatically adjusted using an accumulator coupled proximate an inlet of a condenser based at least partially on the determination (operation 240). For example, when the cooling operation is allowed, operation of the air conditioning with a first level of refrigerant may be allowed; and when the reheat operation is allowed, operation of the air conditioning with a second level of refrigerant may be allowed. Since the reheat operation may utilize more refrigerant to operate effectively (e.g., within operation parameters in air conditioning system requirements), the second level of refrigerant may be greater than the first level of refrigerant. Rather than allowing the air conditioning system to operate at a single level, which may cause inefficient operation and/or mechanical failure in the cooling operation, the air conditioning system may automatically adjust the amount of refrigerant in the system. For example, the air conditioning system may automatically adjust between different levels, such as from a first level to a second level.

Process 200 may be implemented by various systems, such as system 100 and/or system 150. In addition, various operations may be added, deleted, and/or modified. For example, the air conditioning system may include more than two operations. For example, the air conditioning system may include a heating operation (e.g., to deliver heat to a location). In some implementations, the air conditioning system may monitor one or more conditions based at least partially on instructions stored in a memory of the air conditioning system (e.g., the air conditioning system may include instructions that determine which conditions, such as temperature, humidity, and/or pressure, to monitor). The air conditioning system may include a set of criteria at least partially upon which the determination of whether to allow the cooling operation or reheat operation is based. The air conditioning system may retrieve the criteria from a memory of the system and allow operation based on the criteria. In some implementations, a valve coupled to an outlet of the reheater may be a check valve that restricts flow of refrigerant from an inlet of the condenser to the reheater. In some implementations, the amount of refrigerant is automatically adjusted between more than two levels using more than one accumulator (e.g., a first accumulator is approximately filled for a first level and a second accumulator is approximately filled to achieve a second level, and neither accumulators are approximately filled in a third level)

In some implementations, a first condition may be specified (e.g., a default or a user specified setting) and the air conditioning system may receive a request for operation of the air conditioning system based on a second condition. For example, humidity may be specified as a default and a user may request operation based on a temperature setpoint. A temperature and/or temperature range may be specified as a default and a user may request operation based on a humidity setpoint (e.g., in humidity sensitive manufacturing). In some implementations, the air conditioning system may include a default for a first condition, such as humidity, and may receive a setpoint from a user (e.g., via a request for operation). The air conditioning system may adjust the setpoint humidity from the default humidity based on the humidity from the setpoint received from a user.

In some implementations, using an accumulator coupled proximate an inlet of the condenser to automatically adjust an amount of refrigerant may decrease wear on the air conditioner, decrease chances of mechanical failure, decrease costs, and/or increase efficiencies. In some implementations, the condenser may be a microchannel condenser (e.g., condenser with a channel size less than approximately 1 mm). Microchannel condensers may be sensitive to operating conditions during operation of the air conditioning system (e.g., when compared with other condensers (e.g., condenser with tube size greater than 5 mm). For example, microchannel condensers may be sensitive to refrigerant charge (e.g., a level of refrigerant in the system). When a microchannel condenser has a refrigerant charge greater than a maximum operating charge, the pressure in the microchannel condenser may become elevated due to the refrigerant capacity size difference between the microchannel condenser and the evaporator. The high pressures (e.g., pressures greater than approximately 615 psi, with a refrigerant that includes R-410A refrigerant) may cause mechanical failure, including prefailure events, such as excessive wear on parts and/or high pressure switch activations. Thus, if the amount of refrigerant in an air conditioning system is not adjusted based on whether an air conditioning system is operating in a reheat operation (e.g., since operation of an air conditioning system with a reheater uses a greater level of refrigerant than operation of an air conditioning system without a reheater), mechanical failure of the air conditioning system may occur.

In some implementations, automatically adjusting an amount of refrigerant in an air conditioning system based at least partially on the operation mode may allow the system to be more efficient since use of less refrigerant (e.g., a level of refrigerant approximately within range of operation levels for the air conditioning system) during a cooling operation may be more efficient than operating the air conditioning system in a cooling operation with a greater charge (e.g., greater than the range of operation levels).

Figure 3:
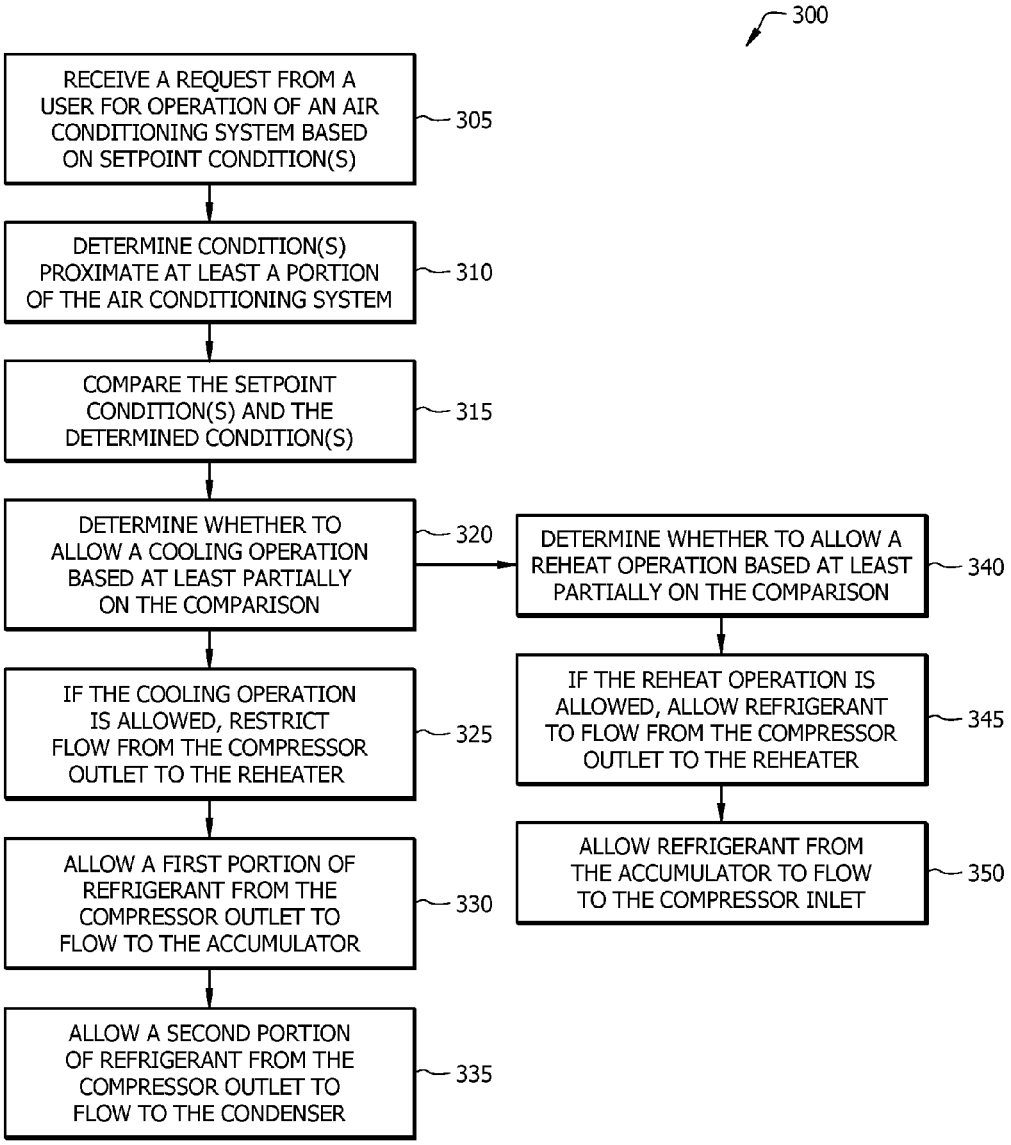
FIG. 3 illustrates an implementation of an example process for operating an example air conditioning system, such as the air conditioning system illustrated in FIGS. 1A and/or 1B.

FIG. 3 illustrates an implementation of an example process 300 for operation of an air conditioning system. As illustrated, a request for operation of an air conditioning system based on setpoint condition(s) may be received (operation 305). For example, the air conditioning system may receive the setpoint via a thermostat. The received setpoint(s) may be stored in a memory coupled to the air conditioning system.

Condition(s) proximate at least a portion of the air conditioning system may be determined (operation 310). For example, the condition(s) may be measured proximate a thermostat of an air conditioning system. The condition(s) may be measured and the conditions in the setpoint conditions may be determined based on the measurements. For example, a humidity setpoint may be received and humidity may be determined based on the measured condition(s).

The setpoint condition(s) may be compared to the determined condition(s) (operation 315). For example, a setpoint temperature may be compared to a determined temperature. A setpoint humidity may be compared to a determined humidity.

A determination may be made whether to allow a cooling operation based at least partially on the comparison (operation 320). For example, the cooling operation may be allowed when one or more determined condition(s) is not within a predetermined range of the setpoint condition(s). In some implementations, a cooling operation may be allowed when the temperature is approximately equal to the setpoint temperature. When the cooling operation is allowed, a signal may be transmitted to a valve coupled to an outlet of the compressor (e.g., valve A 135 illustrated in FIGS. 1A and 1B) so that the valve may be positioned in a first setting.

If the cooling operation is allowed, then flow from the compressor outlet to the reheater may be restricted (operation 325). For example, a signal may be sent from a controller to a valve coupled to the compressor outlet (e.g., valve A 135 illustrated in FIGS. 1A and 1B) to restrict fluid flow from the compressor outlet to the reheater. Operation of the reheater may be restricted (e.g., turned off) during the cooling operation, in some implementations.

A first portion of the refrigerant may be allowed to flow from the compressor outlet to the accumulator (operation 330). A second portion of refrigerant may be allowed to flow from the compressor outlet to the condenser (operation 335). The second portion of the refrigerant may be a greater amount than the first portion of refrigerant. The line coupling the outlet of the compressor and the inlet of the condenser may be coupled to the accumulator such that refrigerant may flow into and out of the accumulator without substantial inhibition (e.g., a valve does not restrict flow into and/or from the accumulator), in some implementations. Thus, as refrigerant is allowed to flow from the compressor to the condenser (e.g., through a four-way valve, such as valve A 135 illustrated in FIG. 1A, 1B), a portion of the refrigerant may flow into the accumulator. When the accumulator is full (e.g., with gaseous and/or liquid refrigerant) or approximately full, the refrigerant may flow to the condenser and bypass entry into the accumulator.

A determination may be made whether to allow a reheat operation based at least partially on the comparison (operation 340). For example, the reheat operation may be allowed when one or more determined condition(s) is within a predetermined range of the setpoint condition(s). In some implementations, a reheat operation may be allowed when the determined temperature is within a predetermined range of the setpoint temperature. When the reheat operation is allowed, a signal may be transmitted to a valve coupled to an outlet of the compressor so that the valve may be positioned in a second setting.

If the reheat operation is allowed, the refrigerant may be allowed to flow from the compressor outlet to the reheater (operation 345). For example, a signal may be transmitted to the valve coupled to an outlet of the compressor (e.g., valve A 135 illustrated in FIGS. 1A and 1B) to direct flow of refrigerant to the reheater. The reheater may elevate the temperature of the air as it flows past the reheater. Refrigerant may be allowed to flow to the inlet of the condenser from the outlet of the reheater.

Refrigerant may be allowed to flow from the accumulator to the compressor inlet (operation 350). A signal may be transmitted to the valve coupled to the outlet of the compressor to allow the accumulator to be coupled to the suction line of the compressor. Allowing the accumulator to be coupled to the suction line of the compressor may reduce the pressure of the refrigerant in the accumulator and allow refrigerant in the accumulator to flow to the inlet of the compressor.

Process 300 may be implemented by various systems, such as system 100 and/or system 150. In addition, various operations may be added, deleted, and/or modified. In some implementations, process 300 may be performed in combination with other processes and/or operations of processes, such as process 200. For example, the air conditioning system (e.g., a module of the air conditioning system) may retrieve one or more predetermined ranges from a memory of the system. The comparison of the determined condition(s) to the setpoint condition(s) may be based at least partially on the retrieved ranges. For example, a determined temperature may be compared to a predetermined range about a setpoint temperature (e.g., determined temperature is compared to a range of plus or minus 5 degrees of the setpoint temperature). In some implementations, a second valve coupled to the line coupling the inlet of the condenser and the outlet of compressor may be a check valve that restricts flow from the inlet of the condenser to the valve proximate the compressor outlet (e.g., valve A 135 illustrated in FIGS. 1A and 1B) and thus to the suction line.

Figure 4:
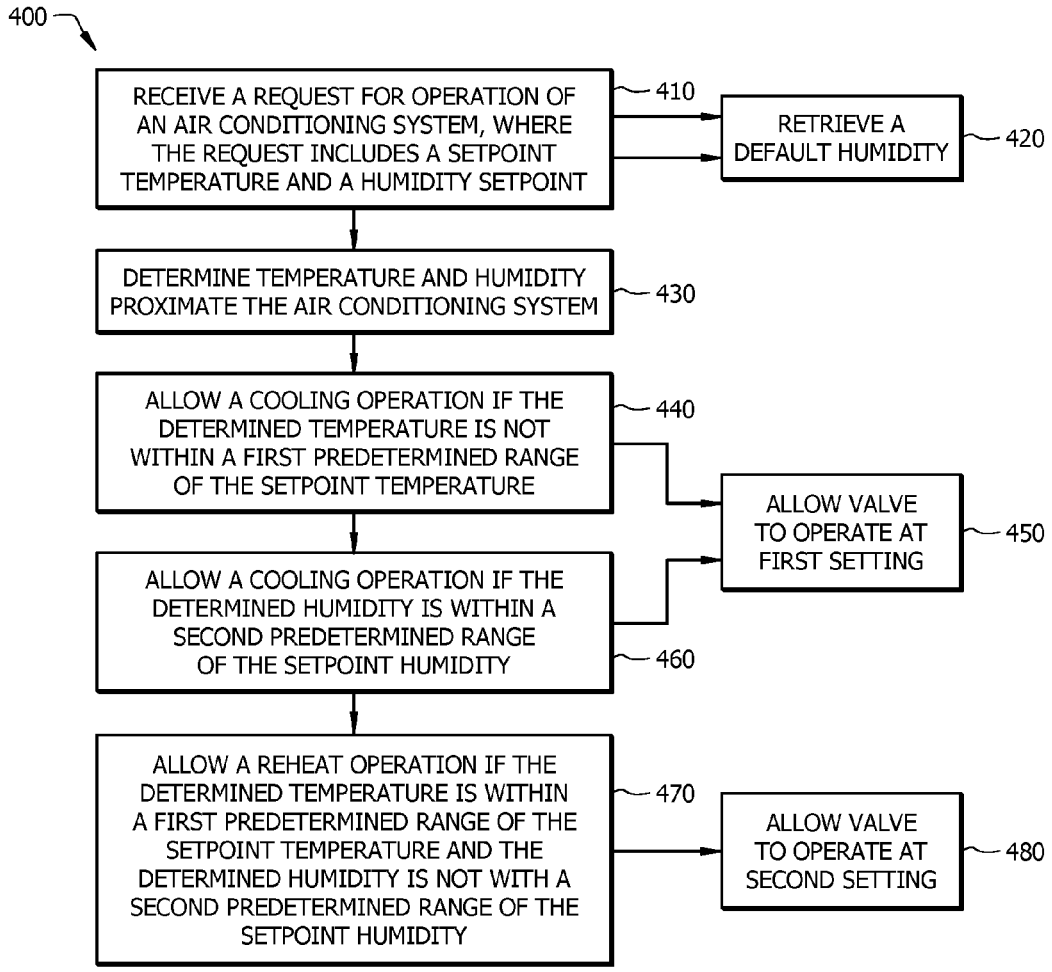
FIG. 4 illustrates an implementation of an example process for operating an example air conditioning system, such as the air conditioning system illustrated in FIGS. 1A and/or 1B.

FIG. 4 illustrates an implementation of an example process 400 for operation of an air conditioning system. As illustrated, a request for operation of an air conditioning system may be received (operation 410). The request may include a setpoint temperature and a setpoint humidity. The humidity may be a relative and/or an absolute humidity.

A default humidity may be retrieved (operation 420). In some implementations, a default humidity may be retrieved to be the setpoint humidity. For example, if the user provides a setpoint temperature and not a setpoint humidity, a default humidity may be retrieved from a memory of the air conditioning system.

A temperature and a humidity proximate at least a portion of the air conditioning system may be determined (operation 430). For example, sensor(s) may be disposed proximate a portion of the air conditioning system (e.g., thermostat, evaporator, and/or location in which air is to be provided). The sensor(s) may measure conditions and the temperature and the humidity may be determined based at least partially on the measured conditions.

A cooling operation may be allowed if the determined temperature is not within a first predetermined range of the setpoint temperature (operation 440). The air conditioning system may retrieve a first predetermined range from a memory of the system (e.g., via an operation module of the controller). For example, the predetermined range may be 3 degrees above or below the setpoint temperature. The cooling operation may reduce air temperature and dehumidify air provided to a location.

A valve may be allowed to operate at a first setting (operation 450). During the cooling operation, a valve (e.g., such as valve A 135 illustrated in FIGS. 1A and 1B and/or other four-way valves) proximate the outlet of the compressor may be allowed to operate at a first setting. For example, the controller may transmit a signal to the valve to operation at a first setting. The first setting may restrict flow of refrigerant from a compressor outlet to the inlet of the reheater and allow refrigerant flow from a compressor outlet to the accumulator and/or inlet of the condenser.

A cooling operation may be allowed if the determined humidity is within a second predetermined range of the setpoint humidity (operation 460). The second predetermined range may be retrieved (e.g., by the operation module of the controller). The second predetermined range may be similar or different from the first predetermined range. For example, the second predetermined range may be 10% of the setpoint (e.g., within plus or minus 10% of the setpoint). In some implementations, the second predetermined range may include 10 percent relative humidity above or below the setpoint humidity. If the cooling operation is allowed, the valve may be allowed to operate at the first setting (operation 450).

A reheat operation may be allowed if the determined temperature is within the first predetermined range of the setpoint temperature and the determined humidity is not within the second predetermined range of the setpoint humidity (operation 470). For example, the determined temperature may be compared to setpoint temperature to determine if the determined temperature is within a tolerance (e.g., predetermined range) of the setpoint temperature. To inhibit overcooling of the air provided to a location, the reheat operation may be allowed to continue to dehumidify air provided to a location (e.g., until it is approximately equal to a setpoint humidity) while increasing the temperature of the air prior to allowing the air to flow to the conditioned space. Thus, the air that flows to the conditioned space may be less cool (e.g., be reduced in temperature less than if the cooling operation was allowed) while allowing dehumidification of the air.

The valve may be allowed to operate at a second setting (operation 460). For example, the controller (e.g., an operation module of the controller) may transmit a signal to the valve coupled to an outlet of the compressor (e.g., valve A 135 illustrated in FIGS. 1A and 1B) to operate the valve at the second setting. The second setting may allow refrigerant to flow to the reheater prior to flowing to the condenser. The second setting may empty or partially empty the refrigerant in the accumulator by coupling the accumulator to the suction line. The flow of refrigerant from the compressor outlet to the condenser may be restricted.

Process 400 may be implemented by various systems, such as system 100 and/or system 150. In addition, various operations may be added, deleted, and/or modified. In some implementations, process 400 may be performed in combination with other processes and/or operations of processes, such as process 200 and/or process 300. For example, other conditions proximate the air conditioning system and/or portions thereof may be determined. The air conditioning system may not retrieve a default humidity and/or other condition. In some implementations, the air conditioning system may operate in a default operation mode, such as the cooling mode and adjust the operation mode to the reheat operation when criteria are satisfied. For example, criteria may include when a first condition, such as temperature, is within a first predetermined range of a setpoint condition and when a humidity is not within a second predetermined range of a setpoint humidity. In some implementations, an operation of an air conditioning system may be restricted when one or more of the determined conditions requested by the user are within a predetermined range of setpoint condition(s). For example, when a determined temperature is within a third predetermined range of the setpoint temperature and when a determined humidity is within a fourth predetermined range of the setpoint humidity, operation of the air conditioning system may be restricted. The third predetermined range may be similar or different from the first predetermined range. The fourth predetermined range may be similar or different from the second predetermined range.

Although a specific controller has been described in FIGS. 1A and 1B, the controller may be any appropriate computer or other programmable logic device. The controller may include a processor that executes instructions and manipulates data to perform operations of the controller. Processor may include a programmable logic device, a microprocessor, or any other appropriate device for manipulating information in a logical manner and memory may include any appropriate form(s) of volatile and/or nonvolatile memory, such as RAM and/or Flash memory.

The memory may include data, such as data useful to the operation of the air conditioning system and/or modules of the air conditioning system. In addition, various software may be stored on the memory. For example, instructions (e.g., operating systems and/or other types of software), and modules such as operation modules may be stored on the memory. In some implementations, the modules, such as an operation module may perform one or more of the operations described in process 200, 300, and/or 400, as illustrated in FIGS. 2-4. In some implementations, modules may be combined, such as into a single module or multiple modules or may be distinct modules. In an implementation, operation modules may include various modules and/or sub-modules.

The controller may include a communication interface that may allow the controller to communicate with components of the air conditioning system, other repositories, and/or other computer systems. The communication interface may transmit data from the controller and/or receive data from other components, other repositories, and/or other computer systems via network protocols (e.g., TCP/IP, Bluetooth, and/or Wi-Fi) and/or a bus (e.g., serial, parallel, USB, and/or FireWire). Operations of the air conditioning system may be stored in a memory and may be updated and/or altered through the communication via network protocols (e.g., remotely through a firmware update and/or by a device directly coupled to the controller).

The controller may include a presentation interface (e.g., a portion of the thermostat) to present data to a user, such as though a monitor and speakers. The presentation interface may facilitate receipt of requests for operation from users.

A client (e.g., control panel in field or building) may allow a user to access the controller and/or instructions stored on the controller. The client may be a computer system such as a personal computer, a laptop, a personal digital assistant, a smart phone, or any computer system appropriate for communicating with the controller. For example, a technician may utilize a client, such as a tablet computer, to access the controller. As another example, a user may utilize a client, such as a smart phone, to access the controller and request operations.

In various implementations, the controller can be implemented through computers such as servers, as well as a server pool. For example, controller may include a general-purpose personal computer (PC) a Macintosh, a workstation, a UNIX-based computer, a server computer, or any other suitable device. According to one implementation, controller may include a web server. Controller may be adapted to execute any operating system including UNIX, Linux, Windows, or any other suitable operating system. The controller may include software and/or hardware in any combination suitable to provide access to data and/or translate data to an appropriate compatible format.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable signal(s) may be non-transitory waves and/or non-transitory signals.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "an accumulator" includes a combination of two or more accumulators; and, reference to "a valve" includes different types and/or combinations of valves. Reference to "a compressor" may include a combination of two or more compressors. As another example, "coupling" includes direct and/or indirect coupling of members.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for managing refrigerant charge in an air conditioner having a compressor, a reheater and an accumulator, the method comprising:

receiving a request from a user for operation of an air conditioner;

determining a temperature and a humidity in a location to be cooled;

if the determined temperature is not within a predetermined range of a setpoint temperature and the humidity is within a predetermined range of a setpoint humidity, performing a cooling operation while restricting a flow of refrigerant to the reheater using a first valve setting, wherein the first valve setting allows the refrigerant to flow to the accumulator; and if the determined temperature is not within a predetermined range of a setpoint temperature and the humidity is not within a predetermined range of a setpoint humidity, performing a cooling operation while allowing the flow of refrigerant to the reheater using a second valve setting, wherein the second valve setting at least partially empties refrigerant in the accumulator.

2. The method of claim 1 wherein the setpoint humidity comprises a default humidity.

3. The method of claim 2 further comprising:

receiving a request for alteration of the default humidity; and adjusting the setpoint humidity based on the request for alteration.

4. The method of claim 1 further comprising allowing the cooling operation, if the determined humidity is within a second predetermined range of the setpoint humidity and the determined temperature is not within the predetermined range of the setpoint temperature.

5. The method of claim 1 further comprising restricting operation of the air conditioner, if the determined humidity is within a second predetermined range of the setpoint humidity and the determined temperature is within the predetermined range of the setpoint temperature.

6. The method of claim 1 wherein the setpoint humidity comprises at least one of a relative humidity or an absolute humidity.

7. An air conditioning system comprising:

a compressor;

a reheater;

an accumulator; and a valve fluidly coupled to the compressor, the reheater and the accumulator, the valve having a first setting that restrict a flow of refrigerant to the reheater and allows the refrigerant to flow to the accumulator, and the valve having a second setting that allows the flow of refrigerant to the reheater and at least partially empties refrigerant in the accumulator;

wherein the valve is in the first setting if the determined temperature is not within a predetermined range of a setpoint temperature and the humidity is within a predetermined range of a setpoint humidity, and the valve is in the second setting if the determined temperature is not within a predetermined range of a setpoint temperature and the humidity is not within a predetermined range of a setpoint humidity.

8. The system of claim 7 further comprising a microchannel condenser fluidly coupled to the compressor and reheater.

9. The system of claim 7 wherein the valve comprises a four-way valve.

10. The system of claim 7 further comprising: a first check valve to restrict flow of refrigerant from a condenser inlet through the first check valve to a compressor outlet; and a second check valve to restrict flow of refrigerant from a condenser inlet through the second check valve to the reheater.

11. The system of claim 7 further comprising: a first check valve to restrict flow of refrigerant from a condenser inlet through the first check valve to a compressor outlet; and a second check valve to restrict flow of refrigerant from a condenser inlet through the second check valve to the reheater, wherein the accumulator is coupled to the line coupling the valve and the first check valve.

12. The system of claim 7 further comprising an indoor portion of the air conditioning system, wherein the indoor portion of the air conditioning system comprises the evaporator and the accumulator.

13. The system of claim 7 further comprising an outdoor portion of the air conditioning system, wherein the outdoor portion of the air conditioning system comprises the condenser and the accumulator.

14. The system of claim 7 further comprising a controller comprising an operating module adapted to determine whether to allow a cooling operation or a reheat operation.

15. The system of claim 7 further comprising a controller comprising an operating module adapted to determine whether to allow a cooling operation or a reheat operation, wherein determining whether to allow a cooling operation or a reheat operation comprises comparing one or more setpoint conditions to one or more conditions determined proximate at least a portion of the air conditioner.

* * * * *